United States Patent [19]

Braley

[11] 4,102,479

[45] Jul. 25, 1978

[54] THIMBLE STRUCTURE

[76] Inventor: Gertrude Braley, 5602 Palos Verdes Blvd., Torrance, Calif. 90505

[21] Appl. No.: 791,779

[22] Filed: Apr. 28, 1977

[51] Int. Cl.[2] ..... D05B 91/04

[52] U.S. Cl. ..... 223/101

[58] Field of Search ..... 223/101; 2/21

[56] References Cited

U.S. PATENT DOCUMENTS

| | | | |
|---|---|---|---|
| 297,355 | 4/1884 | Demme | 223/101 |
| 421,301 | 2/1890 | McIntosh | 223/101 |
| 490,733 | 1/1893 | Armat | 2/21 |
| 1,175,180 | 3/1916 | Sargent | 223/101 |
| 1,197,388 | 9/1916 | Mullen | 223/101 |
| 2,502,266 | 3/1950 | Mateo | 2/21 |

FOREIGN PATENT DOCUMENTS

| | | | |
|---|---|---|---|
| 961,425 | 6/1964 | United Kingdom | 223/101 |

*Primary Examiner*—George H. Krizmanich
*Attorney, Agent, or Firm*—William C. Babcock

[57] ABSTRACT

A thimble that is characterized by having a resilient frusto-conical shaped resilient liner secured to the interior surface thereof, which liner cooperates with a concentrically disposed resilient pad supported by a pedestal from the end piece of the thimble to define a circumferentially extending space. The thimble is particularly adapted for use by a person having long fingernails. When such a person inserts the fingernail into the thimble, the end portion of the fingernail enters the circumferentially extending space, with the liner resiliently gripping both the fingernail and the exterior portion of the finger adjacent thereto. The end of the finger is in abutting contact with the resilient pad. The liner is formed from a soft coarse resilient material that permits air to the enclosed finger portion and also maintains enclosed finger portion cool and dry. If desired, the longitudinal length of the thimble may be increased by a resilient band that removably grips the bead on the end portion of the thimble opposite the end portion that is closed by the end piece.

1 Claim, 4 Drawing Figures

THIMBLE STRUCTURE

BACKGROUND OF THE INVENTION

1. Field of the Invention

Thimble structure.

2. Description of the Prior Art

Thimbles have, for many years, been used to protect end portions of fingers from inadvertent contact with needles, even though such thimbles are uncomfortable to wear for long periods of time. However, in recent years it has become the custom of many women to have long fingernails, and it is difficult to maintain thimbles in position on fingers having such nails.

The primary object in devising the present invention is to provide a thimble that is comfortable to wear by women having both short and long fingernails, with the thimble when worn permitting the enclosed end portions of the fingers to remain cool and dry, and the resilient liner and pad that form a portion of the thimble due to the porosity thereof permitting circulation of air to the enclosed finger portion.

Another object of the invention is to provide a thimble having the physical characteristics previously mentioned, but with the effective length of the thimble being extended by a resilient band, that removably engages the circular bead that forms an integral part of the open end portion of a conventional thimble.

SUMMARY OF THE INVENTION

The thimble invention as may be seen from the drawings, includes a rigid frusto-conical shell that has first and second ends, with the first end being closed by an end piece that may be of convex or concave configuration. The end piece on the inner surface supports a pedestal that has a resilient pad rigidly secured to the free extremity thereof. A resilient liner is secured to the interior surface of the shell and the portion thereof adjacent the pad cooperating with the pad to define a circumferentially extending space.

When the thimble is removably mounted on a finger, the liner is in resilient gripping contact with both the fingernail and the portion of the finger adjacent thereto, and the end surface of the finger being in abutting contact with the pad. The free end portion of the fingernail is of substantial length which extends downwardly into the circumferentially extending space.

Both the pad and liner are formed from a resilient porous material that allows air circulation to the enclosed finger portion, and maintains the enclosed finger portion cool and dry. The second end of the shell terminates in a circular band of substantial width that extends outwardly from the shell. When it is desired to provide a more effective longitudinal length on the thimble, a circular finger engaging band of resilient material is provided that has a circumferentially extending recess therein that engages the bead, and due to this engagement the band is held in a firm projecting position on the shell and in coaxial alignment therewith. The latter structure of the thimble is particularly effective when the user has a long projecting fingernail, and the liner resiliently engages so little of the finger that the thimble is not firmly held thereon.

DESCRIPTION OF THE PREFERRED EMBODIMENT

Figure 1:
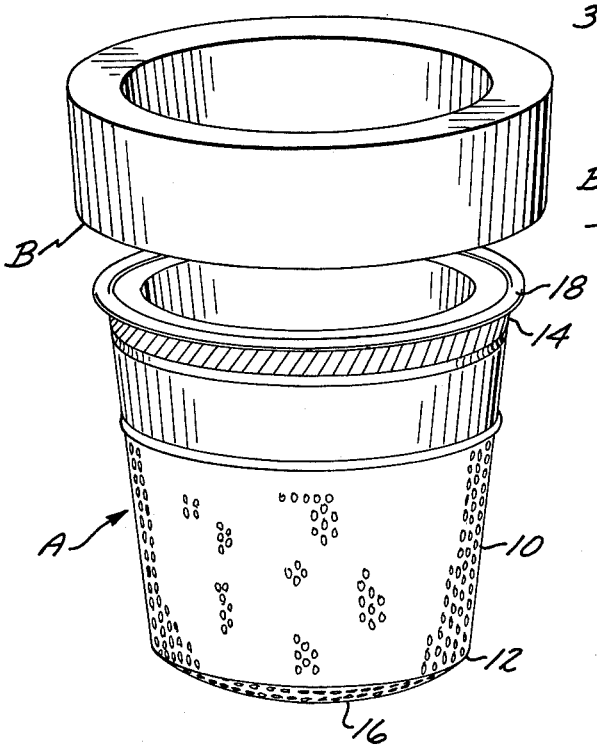
FIG. 1 is a perspective view of a thimble that incorporates the present invention, as well as a resilient band that may be removably secured to the bead of the thimble to increase effective length of the thimble.
Figure 2:
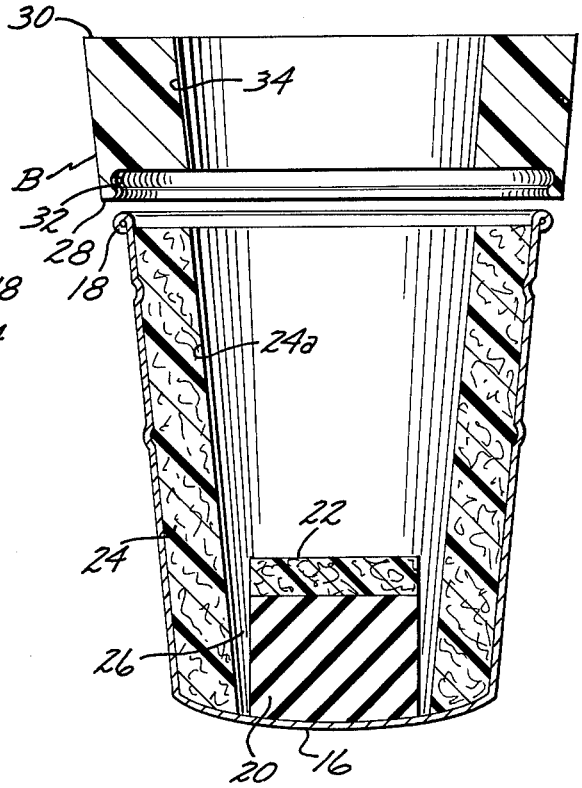
FIG. 2 is a longitudinally extending cross-sectional view of the thimble shown in FIG. 1 and illustrating the resilient liner and pedestal supported resilient pad.
Figure 3:
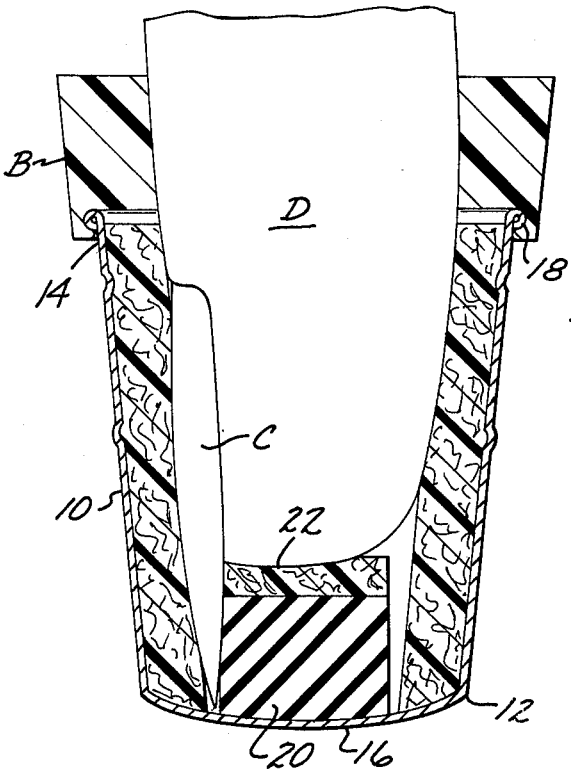
FIG. 3 is the same longitudinal cross-sectional view shown in FIG. 2, but with the band removably secured to the thimble, and the liner and pad in frictional engagement with the extremity of a finger, and the fingernail on the finger being illustrated as of substantial length and extending downwardly into the circumferential space defined between the liner and the pedestal supported resilient pad, and the thimble being illustrated as having a convex end piece.
Figure 4:
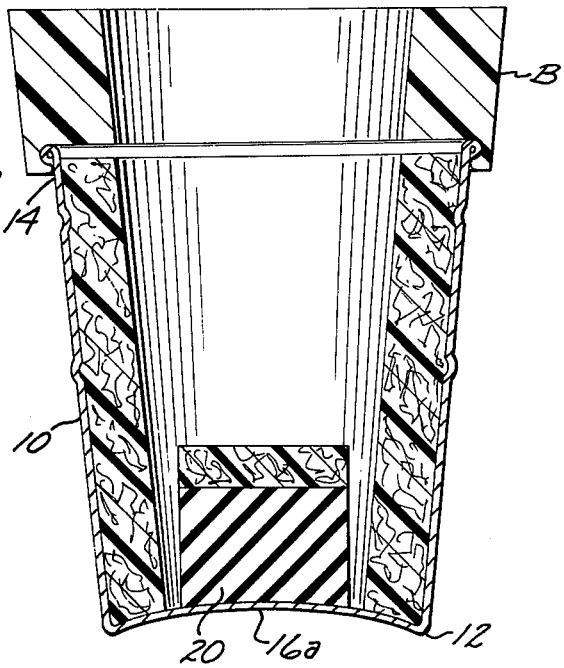
FIG. 4 is a longitudinal cross-sectional view of the thimble shown in FIG. 2 but differing therefrom in having a convex end piece.

A thimble A is shown in the drawings that includes a frusto-conical rigid shell 10 that has a first end 12 and second end 14. The first end 12 is closed by an end piece that may be either an end piece 16 as shown in FIGS. 1, 2 and 3 that is of convex configuration, or an end piece **16*a* as illustrated in FIG. 4 that is of concave configuration. The shell 10 terminates at the second end 14 in a circumferentially extending outer projecting bead 18. Situated within the shell 10 is a pedestal 20 that is secured to the end piece 16 and extends towards the second end 14. The pedestal 20 on the free upper extremity thereof supports a resilient pad 22. A resilient liner 24 is provided that extends the entire circumferential length of the interior surface of the shell 10, and the liner being of such thickenss relative to the pad 22 and pedestal 20 that a circumferentially extending space 26 is defined therebetween. The circumferentially extending space 26 is adapted to have an end portion of a fingernail C on a finger D of a user inserted therein as shown in FIG. 3. Both the liner 24 and the pad 22 are formed from a resilient porous material such as felt, a polymerized resin foam having interconnected cells, or the like, which material due to the porosity thereof allows circulation through the liner 24** to the portion of the finger D cased in the thimble A and as a result the encased finger portion remaining cool and dry.

Should it be desired to increase the effective longitudinal length of the thimble A, the band B shown in the drawings may be employed, which band is formed of a resilient material and has a first end portion 28 and second end portion 30. The first end portion 28 has a circumferentially extending recess 32 formed therein, with the recess 32 removably engaging the bead 18 to firmly hold the band B in position on the shell 10. The band B has a frusto-conical interior surface 34, which is so sized that when the band B is mounted on the shell 10 as shown in FIGS. 3 and 4, the interior surface 34 is a continuation of the interior frusto-conical surface **24*a* of the liner 24. The longitudinal length of the band B is substantially the same as the height of the pedestal 20, and as a result the surfaces 24*a* and 34 have the same effective frictional contact with the end portion of the finger D as would the interior surface 24*a* have with the finger portion if the pedestal were not disposed within the thimble A. Thus, even when the fingernail C is of substantial length and has the extremity thereof situated within the circumferentially extending space 26, the thimble A and band B have the same tendency to remain firmly in position on the finger D, due to the interior surfaces 24***a* and 34 providing the same surface contact with the enclosed finger portion as would occur when the fingernail C is short and the thimble structure has no pedestal 20 or resilient pad 22 therein. The thimble A above described operates in the same manner irrespective of whether it has a convex end piece 16 or concave end piece 16*a*.

The use and operation of the invention has been described previously in detail and need not be repeated.

What is claimed is:

1. In combination with a thimble that includes a frusto-conical shell that has a plurality of spaced transverse perforations therein, said shell having first and second ends; an end piece that closes said first end; an outwardly projecting circular bead on said second end, an assembly that permits said thimble to be worn on a finger that has a projecting finger nail of substantial length, said assembly including:

a. a resilient porous liner secured to the interior surface of said shell to frictionally grip a finger inserted therein, and keep the finger dry from perspiration by allowing air to circulate between the finger and ambient atmosphere through said liner and said perforations;

b. a resilient pad of less transverse cross sectional area than that of said end piece;

c. a pedestal of not greater transverse cross sectional area than said pad that extends from the inner surface of said end piece longitudinally within said shell, with said pedestal supporting said pad on the free end thereof, and said pad and pedestal being spaced from said lines to define a ring-shaped recess into which said fingernail of a user extends when the tip portion of the finger of which said fingernail forms a part is disposed in said thimble; and d. a circular band that has an interiorly disposed recess that engages said bead to support said band from said shell and in longitudinal alignment therewith, said band having an interior frusto-conical surface that is a continuation of said frusto-conical surface in said shell, and said band of substantially the same depth as the height of said pedestal to permit substantially the same length of said tip portion of said finger to be inserted within the interior of said shell and band as would be possible to insert in said shell if said tip portion had no projecting fingernail and said pedestal and pad were not present in said shell.

* * * * *